US006929363B2

(12) United States Patent
Sakai et al.

(10) Patent No.: US 6,929,363 B2
(45) Date of Patent: Aug. 16, 2005

(54) INK CARTRIDGE VACUUM PACKAGE AND INK CARTRIDGE VACUUM PACKAGING METHOD

(75) Inventors: Yasuto Sakai, Shiojiri (JP); Satoshi Shinada, Shiojiri (JP); Koichi Toba, Nagano-ken (JP)

(73) Assignee: Seiko Epson Corporation, Toyko (JP)

( * ) Notice: Subject to any disclaimer, the term of this patent is extended or adjusted under 35 U.S.C. 154(b) by 0 days.

(21) Appl. No.: 10/270,738

(22) Filed: Oct. 16, 2002

(65) Prior Publication Data

US 2003/0081087 A1 May 1, 2003

(30) Foreign Application Priority Data

Oct. 16, 2001 (JP) ..... 2001-318599

(51) Int. Cl.[7] ..... B41J 29/13; B41J 2/175
(52) U.S. Cl. ..... 347/108; 347/86
(58) Field of Search ..... 347/85, 86, 87, 347/108; 206/205, 461, 469, 751, 752

(56) References Cited

U.S. PATENT DOCUMENTS 5,812,166 A * 9/1998 Yamazaki ..... 347/87
5,815,183 A * 9/1998 Sasaki ..... 347/86
5,831,652 A * 11/1998 Hinami et al. ..... 347/86
6,027,208 A * 2/2000 Amano ..... 347/70
6,220,702 B1 * 4/2001 Nakamura et al. ..... 347/86

FOREIGN PATENT DOCUMENTS

EP 0812693 A1 * 12/1997 ..... B41J/2/17

* cited by examiner

*Primary Examiner*—Anh T. N. Vo
(74) *Attorney, Agent, or Firm*—Sughrue Mion, PLLC

(57) ABSTRACT

Creep is prevented in the ink cartridge engaging member resulting from the ink cartridge being vacuum packaged with unnecessary force applied to the engaging member. The ink cartridge vacuum package includes an ink cartridge and outside packaging. The ink cartridge has an ink cartridge body and a flexible engaging member. The engaging member projects away from the side of the ink cartridge body to which it is disposed. The outside packaging vacuum seals the ink cartridge inside while maintaining the engaging member in the same position as when force is not applied to the engaging member.

32 Claims, 12 Drawing Sheets

INK CARTRIDGE VACUUM PACKAGE AND INK CARTRIDGE VACUUM PACKAGING METHOD

RELATED APPLICATIONS

This application claims priority from Japanese Patent Application No. 2001-318599, filed on Oct. 16, 2001. The disclosure of the Japanese application is incorporated herein by reference for all purposes.

BACKGROUND OF THE INVENTION

1. Field of the Invention

An illustrative, non-limiting embodiment of the present invention relates generally to a vacuum package for an ink cartridge and to a method for vacuum packaging an ink cartridge. The embodiment relates more particularly to a vacuum package and a vacuum packaging method for an ink cartridge having a flexible engaging member disposed on the ink cartridge body.

2. Description of Related Art

Ink is typically supplied to an inkjet printer from an ink cartridge that is removably installed on the carriage of the inkjet printer.

One such ink cartridge has a rectangular box-like ink cartridge body and a flexible engaging member disposed on the side of and projecting outward from the ink cartridge body. When the ink cartridge is installed on the carriage, the engaging member of the ink cartridge is flexibly deformed to engage the carriage.

The ink cartridge is typically delivered to the inkjet printer user in an aluminum vacuum pack containing the ink cartridge in order to maintain the quality of the ink until the cartridge is used and to protect the ink cartridge.

A problem with this design is that, because the engaging member for holding the ink cartridge in the carriage projects outwardly from the side of the ink cartridge, the engaging member is easily deformed when the ink cartridge is vacuum packed. A particular problem is that the packaging material shrinks when it is vacuum sealed and the engaging member may be forcibly deformed and held at the side of the ink cartridge. If the packaging is shrunk with the engaging member thus deformed, the engaging member is subject to creep while it remains in the package. When the ink cartridge is later removed from the package, the engaging member remains deformed because of the creeping. As a result, when the ink cartridge is installed in the printer, the engaging member does not sufficiently engage the carriage.

SUMMARY OF THE INVENTION

Illustrative, non-limiting embodiments of the present invention overcome the disadvantages described above and other disadvantages. Also the present invention is not required to overcome the disadvantages described above and other disadvantages, and an illustrative, non-limiting embodiment of the present invention may not overcome any of the disadvantages.

In one non-limiting example, an ink cartridge vacuum package has an ink cartridge body, a flexible engaging member projecting away from the ink cartridge body and packaging that stores the ink cartridge, wherein, when the ink cartridge is stored in the packaging, a force in the direction of the ink cartridge body does not substantially flex the flexible engaging member.

Another non-limiting example relates to a method for vacuum packaging an ink cartridge in a vacuum package. The vacuum packaging method inserts an ink cartridge into a packaging from an opening; maintains a flexible engaging member in a substantially the same position relative to an ink cartridge body of the ink cartridge when force is applied to the flexible engaging member in a direction of the ink cartridge body as when the force is not applied to the flexible engaging member; wherein the flexible engaging member is disposed on and projects from the ink cartridge body; forms a vacuum inside the packaging in which the ink cartridge is inserted; and seals the opening of the packaging in which the ink cartridge is inserted.

BRIEF DESCRIPTION OF THE DRAWINGS

Aspects of illustrative, non-limiting embodiments of the present invention will become more apparent by describing in detail embodiments thereof with reference to the attached drawings in which.

DESCRIPTION OF ILLUSTRATIVE NON-LIMITING EMBODIMENTS OF THE INVENTION

The following description of illustrative non-limiting embodiments of the invention discloses specific configurations and components. However, the embodiments are merely examples of the present invention, and thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations and components of the present invention that are known to one skilled in the art are omitted for the sake of clarity and brevity.

Figure 1:
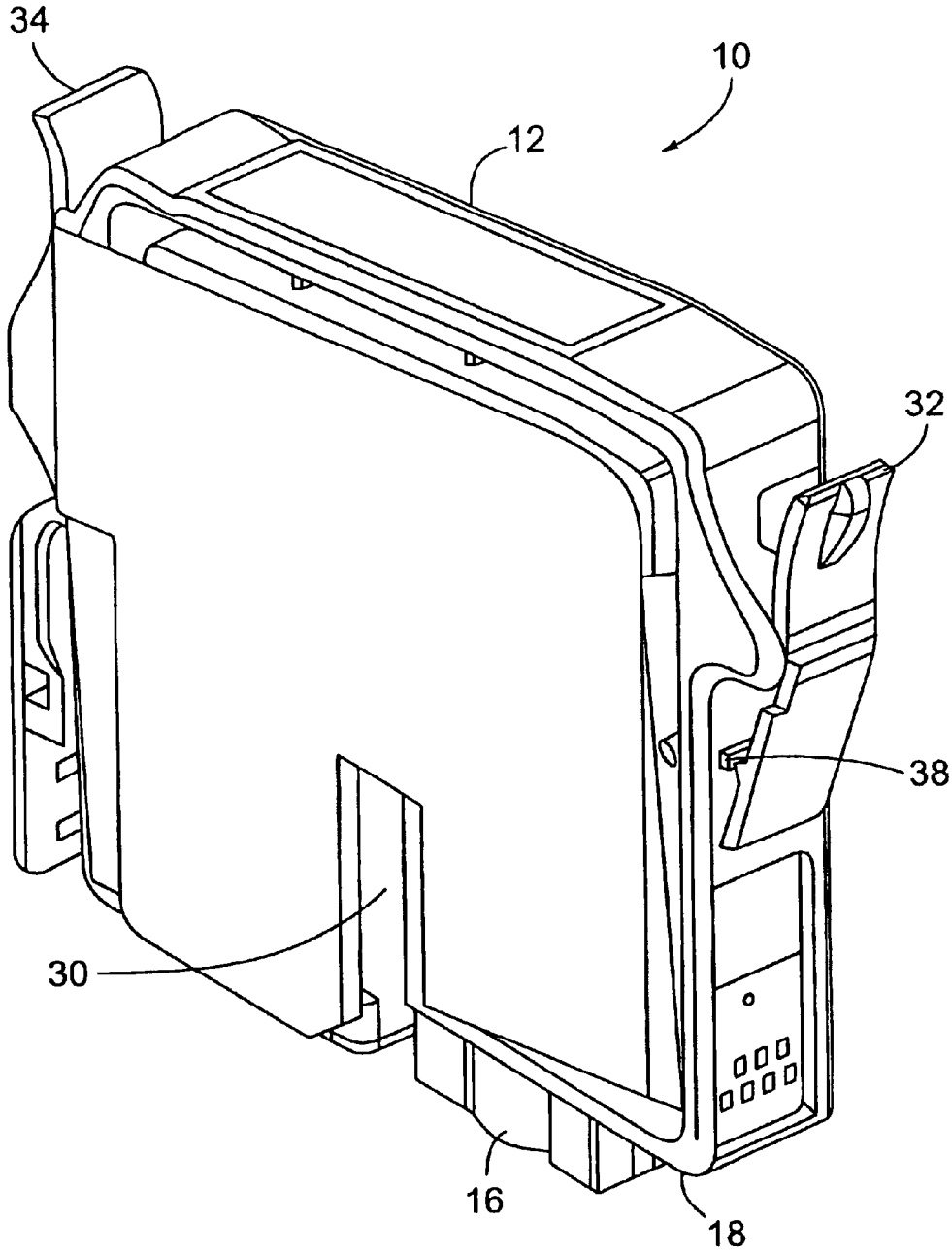
FIG. 1 is a front oblique view of an ink cartridge according to an illustrative, non-limiting embodiment of the present invention.
Figure 2:
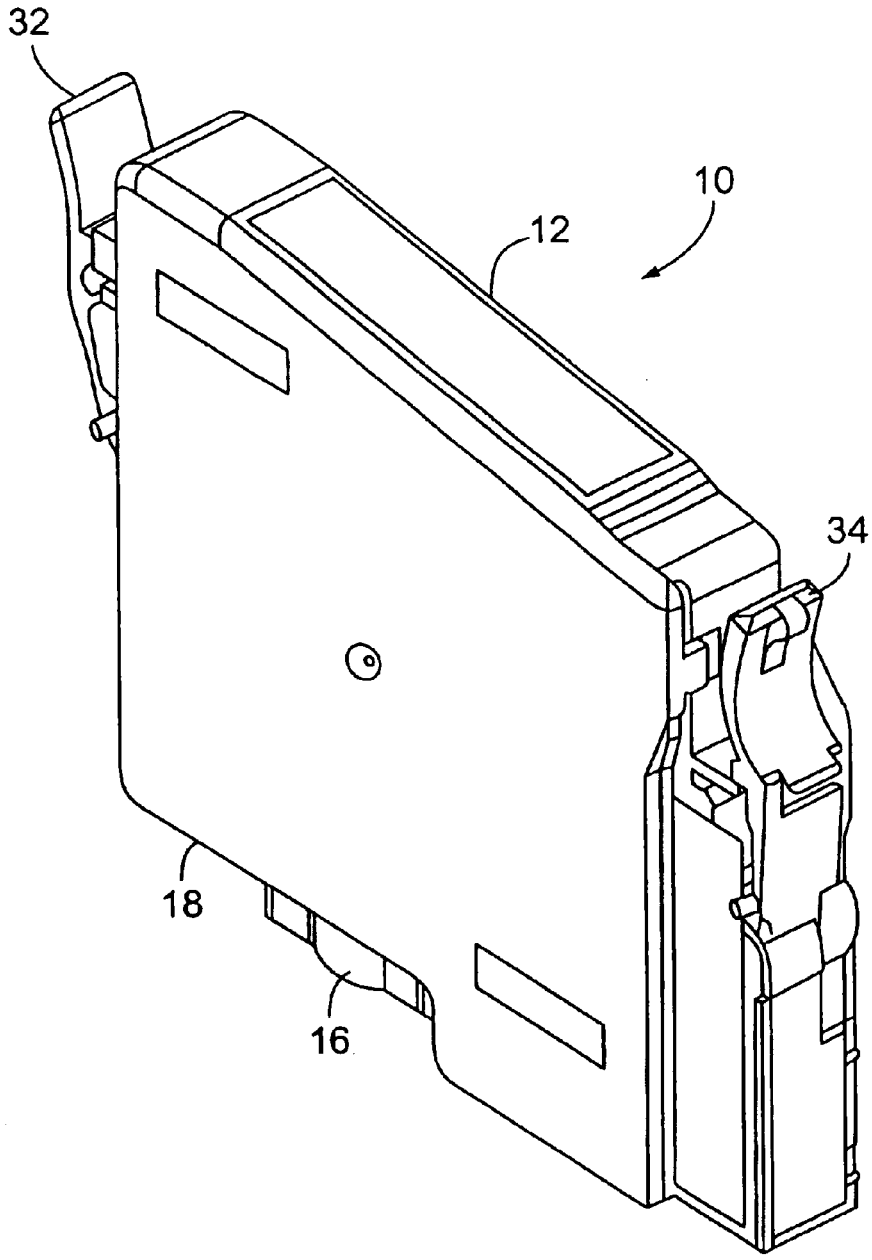
FIG. 2 is a back oblique view of the ink cartridge shown in FIG. 1.

FIG. 1 is a front oblique view of an ink cartridge contained in an ink cartridge vacuum package according to a first illustrative, non-limiting embodiment of the invention and FIG. 2 is an oblique view from the back of the ink cartridge 10 shown in FIG. 1.

The ink cartridge 10 has an ink cartridge body 12 for storing ink. In this embodiment of the invention, the ink cartridge body 12 has an overall rectangular box-like appearance and an ink supply surface 18 with an ink supply opening 16 into which the ink supply needle of the ink jet printer is inserted.

The packaged ink cartridge 10 could be a cartridge that is filled with ink during the manufacturing process or a cartridge that is refilled with ink after use.

A slit 30 extending in the insertion direction of the ink supply needle from the ink supply surface 18 of the ink cartridge body 12 is disposed near the ink supply opening 16 in the middle of one side of the ink cartridge body. In another implementation, the slit may entirely pass through the body 12. When the ink supply needle is inserted into the ink cartridge 10, the slit 30 keeps the open end of the ink supply opening 16 perpendicular to the ink supply needle before the open end of the ink supply opening 16 reaches the ink supply needle, thereby assuring that the ink supply needle is reliably inserted into the ink supply opening 16.

First and second engaging members 32 and 34 for engaging the carriage of the inkjet printer are formed integrally with the ink cartridge body 12 at the top part of the ends of the ink cartridge body 12. Clearly, the members 32 and 34 do not have to be integral with the body 12 and are not limited to the structure shown in FIG. 1.

The first engaging member 32 is disposed on the side near the ink supply opening 16. The first engaging member 32 is a blade-like member projecting upwardly and away from the side of the ink cartridge body 12, from bottom to top, as seen in FIG. 1. This first engaging member 32 is flexible and can be bent toward or pushed away from the side of the ink cartridge body 12 about pivot point 38.

The second engaging member 34 is disposed on the side of the ink cartridge body 12 opposite to the side on which the first engaging member 32 is disposed. The second engaging member 34 is also flexible and can be bent toward or separated away from the side of the ink cartridge body 12.

Figure 3:
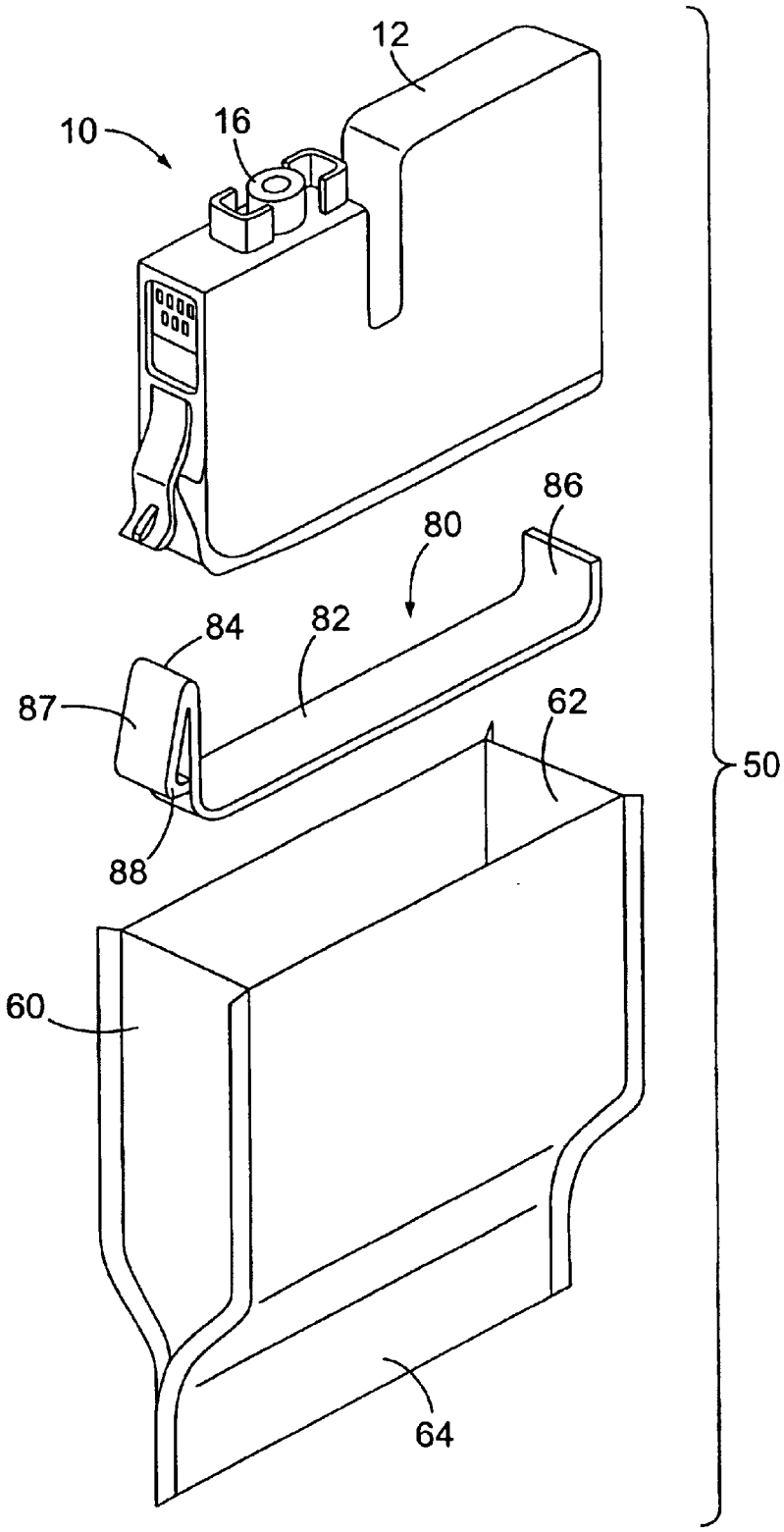
FIG. 3 is an oblique view showing an exploded view of an example of an ink cartridge shown in FIG. 1 and a vacuum package according to an illustrative, non-limiting embodiment of the invention.

FIG. 3 is an oblique view showing an illustrative embodiment of an ink cartridge vacuum package 50. The ink cartridge vacuum package 50 includes the ink cartridge 10, outside packaging 60, and a deformation prevention member 80.

The packaging 60 is a substantially rectangular sack with an opening 62 on one end and a seal part 64 on the opposite end. The opening 62 is open and the seal part 64 is sealed as shown in the figure before the ink cartridge 10 is inserted. The packaging 60 in this embodiment is a material with good airtightness, such as aluminum, and is held with the opening 62 up.

The deformation prevention member 80 has a flat main part 82, a curved first deformation prevention part 84 at one end of the main part 82 and a second deformation prevention part 86 at the other end. The end of the first deformation prevention part 84 is bent back, forming a returned part 87. The end of the returned part 87 is further bent substantially perpendicularly, forming a bent part 88. The deformation prevention member 80 in this embodiment is made from a water-resistant cardboard, for example, but shall not be so limited and could be made from plastic or other material.

As shown in FIG. 3, the ink cartridge 10 is inverted from the position shown in FIG. 1 so that the ink supply opening 16 faces up. The deformation prevention member 80 is inserted between the ink cartridge body 12 of ink cartridge 10 and the first and second engaging members 32 and 34. More particularly, the first deformation prevention part 84 is inserted between the ink cartridge body 12 and first engaging member 32, and the second deformation prevention part 86 is inserted between the ink cartridge body 12 and second engaging member 34 in this embodiment.

Figure 4:
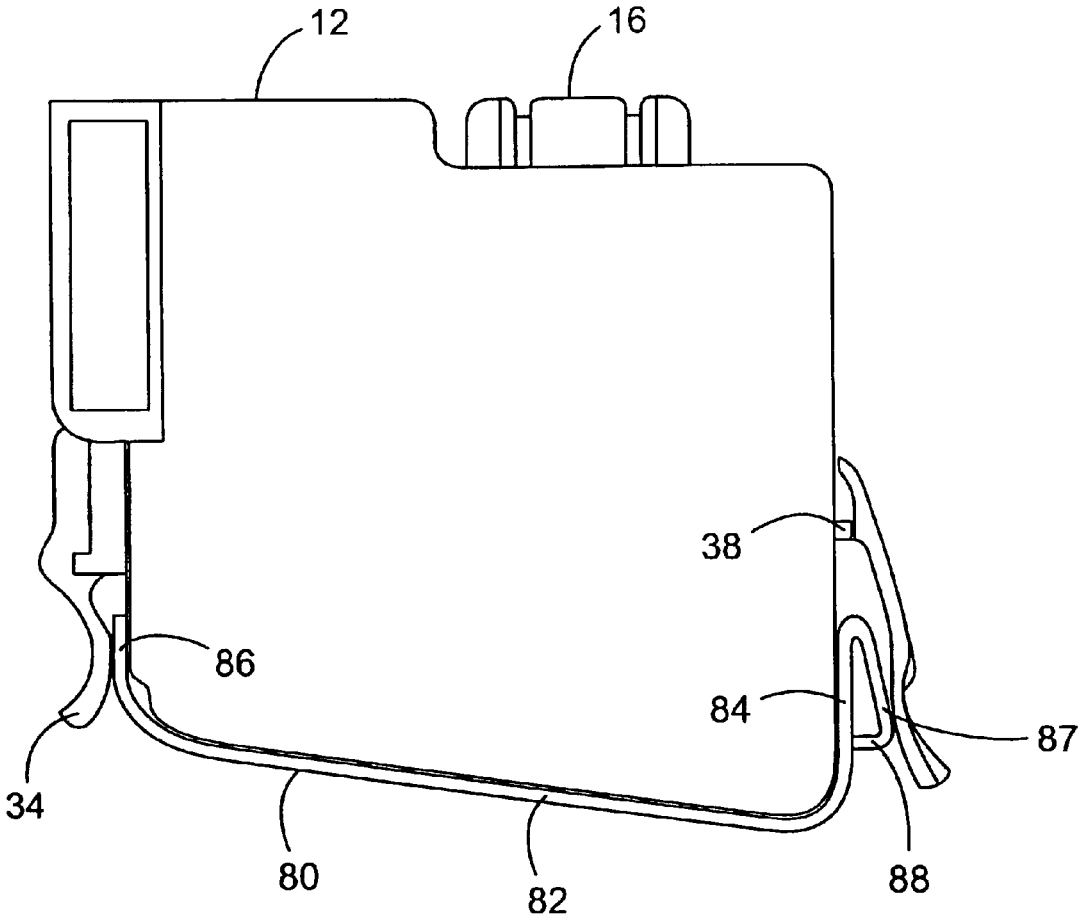
FIG. 4 is a side view showing a deformation prevention member attached to the ink cartridge shown in FIG. 1.

FIG. 4 is a side view in which the deformation prevention member 80 is coupled to the ink cartridge 10.

When the engaging member is not forced towards the ink cartridge body 12, a space exists between the first engaging member 32 and the side of the ink cartridge body 12. Also, in one example, the space is greater than the thickness of the deformation prevention member 80. The returned part 87 and bent part 88 are positioned relative to the first deformation prevention part 84 of the deformation prevention member 80 so that the overall thickness of the first deformation prevention part 84 is at least substantially the same as the gap between the first engaging member 32 and the side of the ink cartridge body 12. As a result, when the first deformation prevention part 84 is inserted between the ink cartridge body 12 and first engaging member 32, the first engaging member 32 is held at the same position relative to the ink cartridge body 12 as when no force is applied to the first engaging member 32.

Furthermore, when the second engaging member 34 is not forced towards the ink cartridge body 12, a gap between the second engaging member 34 and the side of the ink cartridge body 12 is at least substantially equal to the thickness of the deformation prevention member 80. As a result, when the second deformation prevention part 86 is inserted between the ink cartridge body 12 and the second engaging member 34, the thickness of the second deformation prevention part 86 alone keeps the second engaging member 34 at the same position relative to the ink cartridge body 12 as when no force toward the ink cartridge body 12 is applied to the second engaging member 34.

Figure 5:
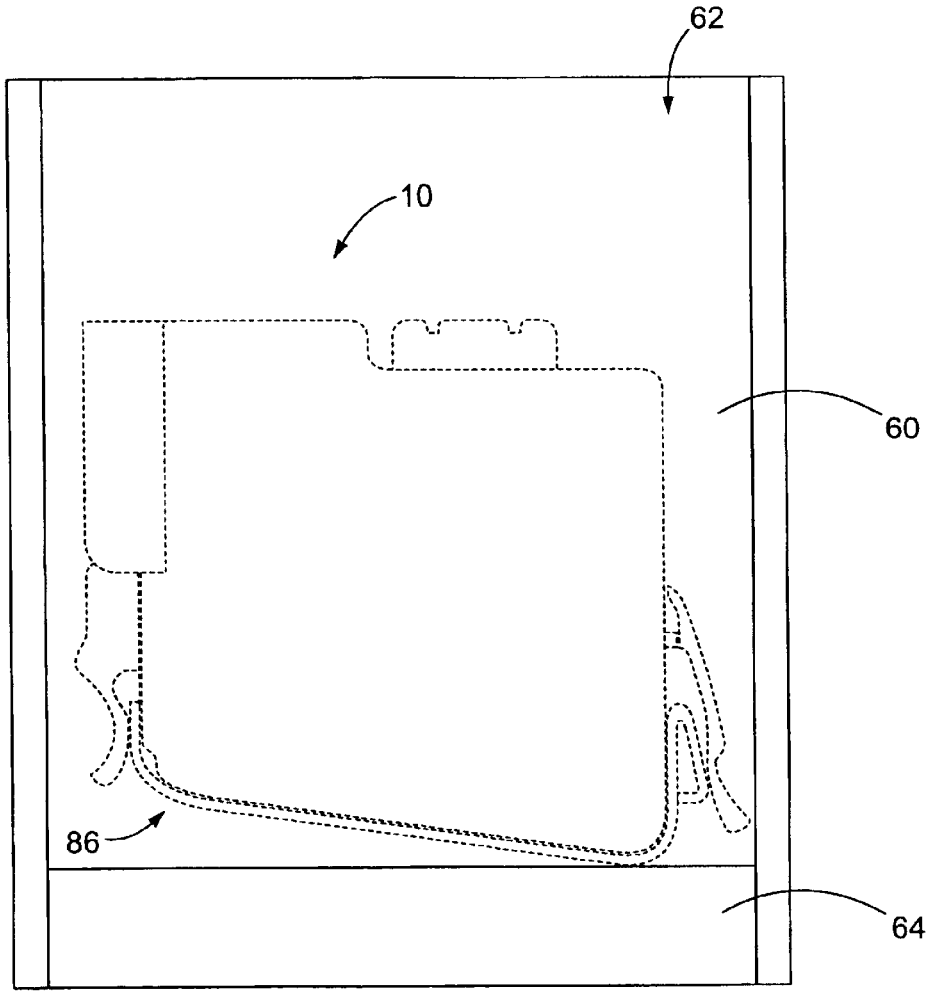
FIG. 5 is a side view showing the ink cartridge inserted into the packaging of FIG. 3.

FIG. 5 is a side view showing the ink cartridge 10 inserted into the packaging 60. The ink cartridge 10 is inserted into the packaging 60 through the package opening 62. The deformation prevention member 80 has already been inserted between the engaging members 32 and 34 and the ink cartridge body 12 and is therefore inserted into the packaging 60 together with the ink cartridge 10.

When the ink cartridge 10 is inserted into the packaging 60, the pressure inside the packaging 60 is reduced. In this non-limiting embodiment of the invention, the packaging 60 is placed in a vacuum packaging unit after the ink cartridge 10 is placed inside the packaging 60, and the pressure is reduced by removing air from the opening 62.

Figure 6:
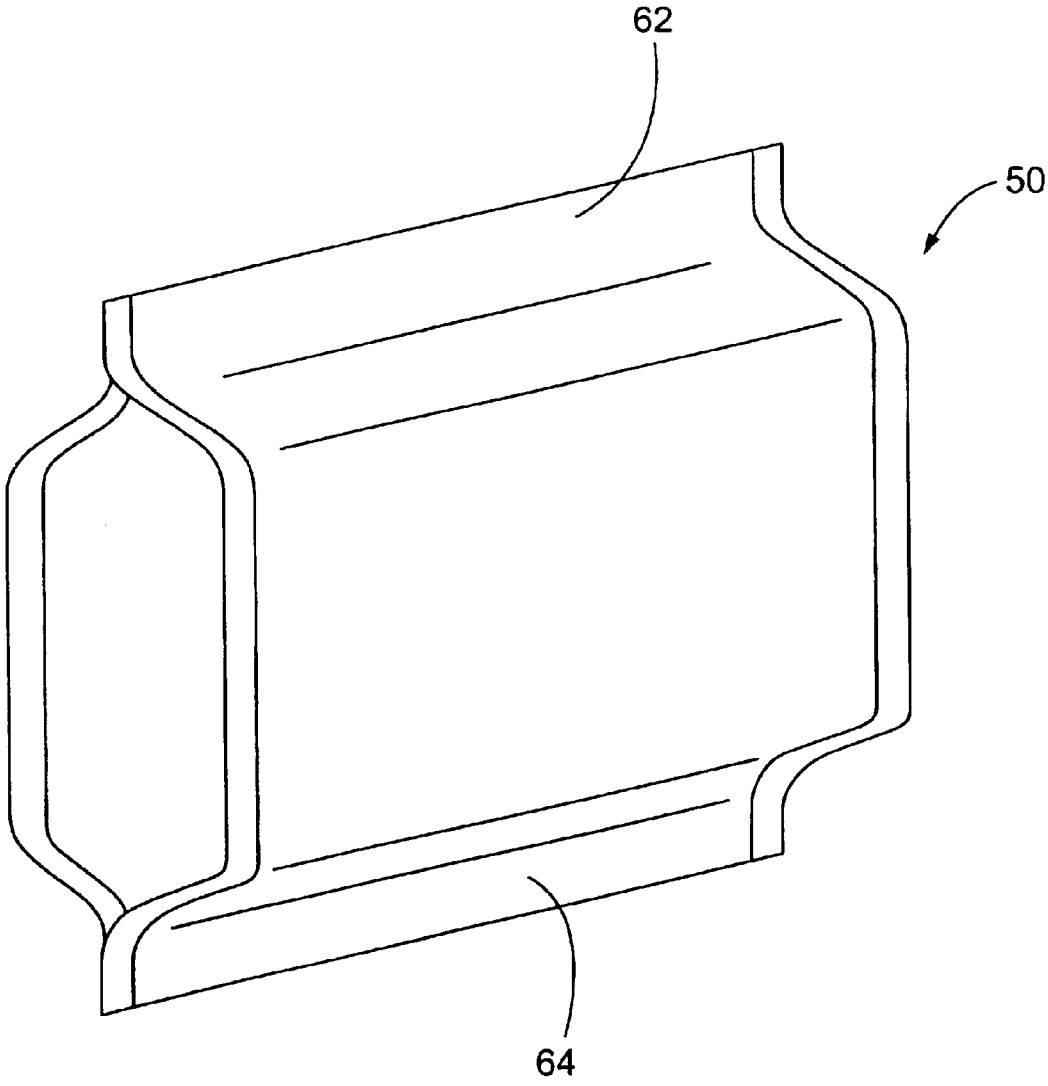
FIG. 6 is an oblique view of the packaging of FIG. 3 after the opening is sealed.

FIG. 6 is an oblique view showing the opening 62 of the packaging 60 after it is sealed. The opening 62 is sealed after removing air and forming a vacuum inside the packaging 60 and the opening 62 is sealed by thermal bonding in this embodiment of the invention.

A pressure differential inside and outside the packaging 60 results when the packaging 60, with ink cartridge 10 inside, is removed from the vacuum packaging unit after sealing the opening 62. The packaging 60 thus shrinks and the ink cartridge 10 is vacuum sealed inside the packaging 60.

Even if a force pushes the first and second engaging members 32 and 34 toward the ink cartridge body 12 when the packaging 60 shrinks, the deformation prevention member 80 maintains the first and second engaging members 32 and 34 in the same state as when this force is not applied. The ink cartridge vacuum package 50 is thus completed. As a result, creep, which occurs when the engaging members 32 and 34 are forcibly deformed toward the side of the ink cartridge body 12, can thus be prevented.

The vacuum space inside the package is also increased by the deformation prevention member 80 in this embodiment. Air bubbles in the ink inside the ink cartridge body 12 are thus conducted into the vacuum space outside the ink cartridge body 12 and are easily absorbed by this space because it is large. The vacuum inside the ink cartridge body 12 can thus be desirably maintained.

Figure 7:
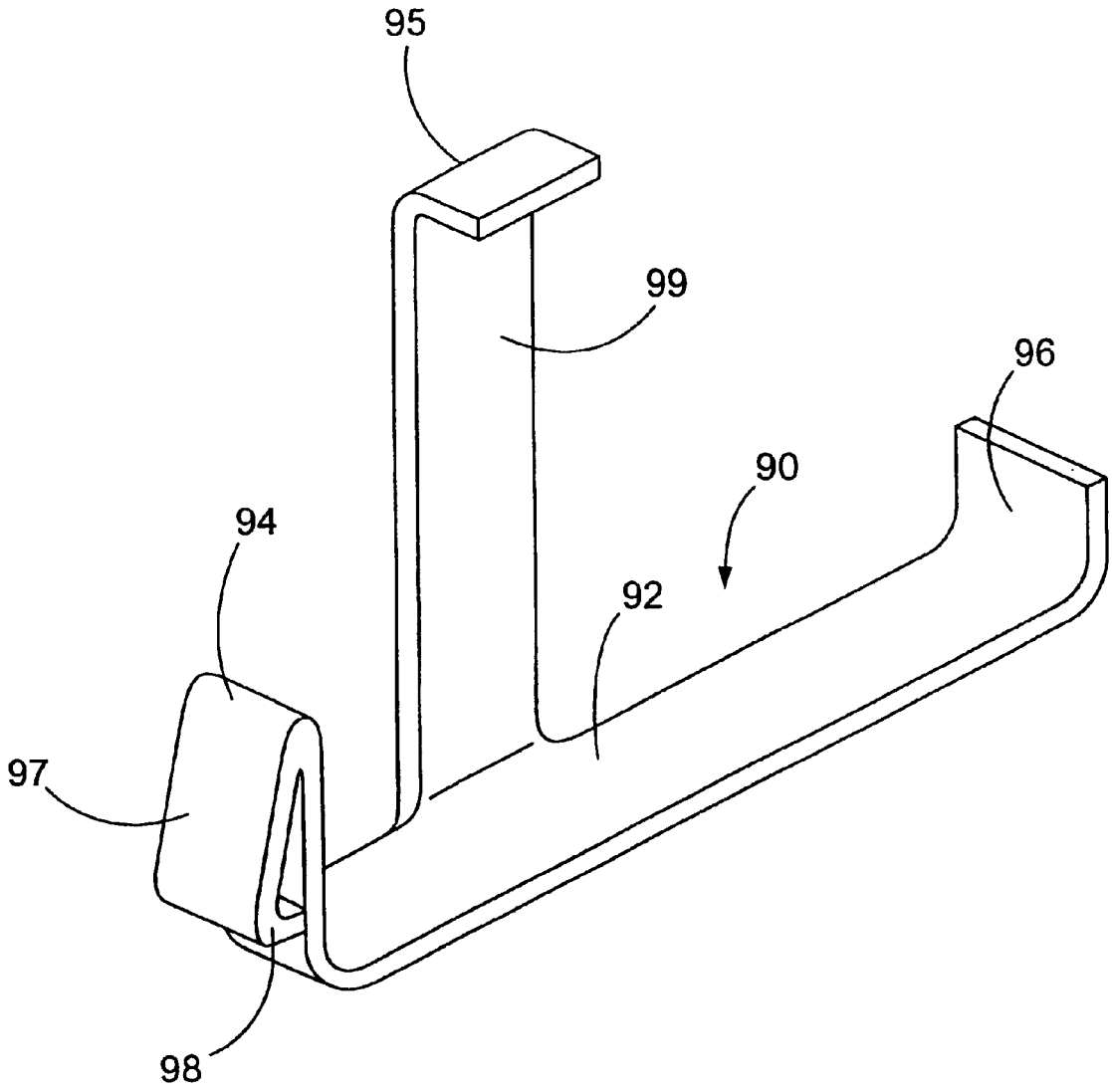
FIG. 7 is an oblique view showing an illustrative example of a deformation prevention member of an ink cartridge vacuum package according to a non-limiting embodiment of the invention.

FIG. 7 is an oblique view of a deformation prevention member 90 for an ink cartridge vacuum package according to another illustrative embodiment of the invention. This embodiment differs from the above embodiment in the configuration of the deformation prevention member 90, but is otherwise similar, and further description of similar features is therefore omitted for brevity.

Similar to the deformation prevention member 80 of the above embodiment, the deformation prevention member 90 has a flat main part 92, a curved first deformation prevention part 94 at one end of the main part 92 and a second deformation prevention part 96 at the other end. The end of the first deformation prevention part 94 is bent back, forming a returned part 97. The end of the returned part 97 is further bent substantially perpendicularly, forming a bent part 98. The deformation prevention member 90 in this embodiment additionally has a supply opening protection part 95 for covering the ink supply opening 16 of ink cartridge 10, and a connecting part 99 connecting the supply opening protection part 95 to the main part 92.

The supply opening protection part 95 is positioned so that it covers the ink supply opening 16 when the first deformation prevention part 94 and second deformation prevention part 96 of the deformation prevention member 90 are inserted between the ink cartridge body 12 and the engaging members 32 and 34. The ink cartridge 10 and deformation prevention member 90 thus engaged are then inserted to the packaging 60. Subsequent operations of vacuum sealing of the cartridge 10 in the packaging are similar to the operations described above.

This embodiment provides the same benefits described above. In addition, the deformation prevention member 90 protects the ink supply opening 16 in the ink cartridge vacuum package, and also, the ink cartridge 10 cannot be installed in the inkjet printer without removing the deformation prevention member 90 from the ink cartridge. This assures that the deformation prevention member 90 will be removed when the ink cartridge is used.

Figure 8:
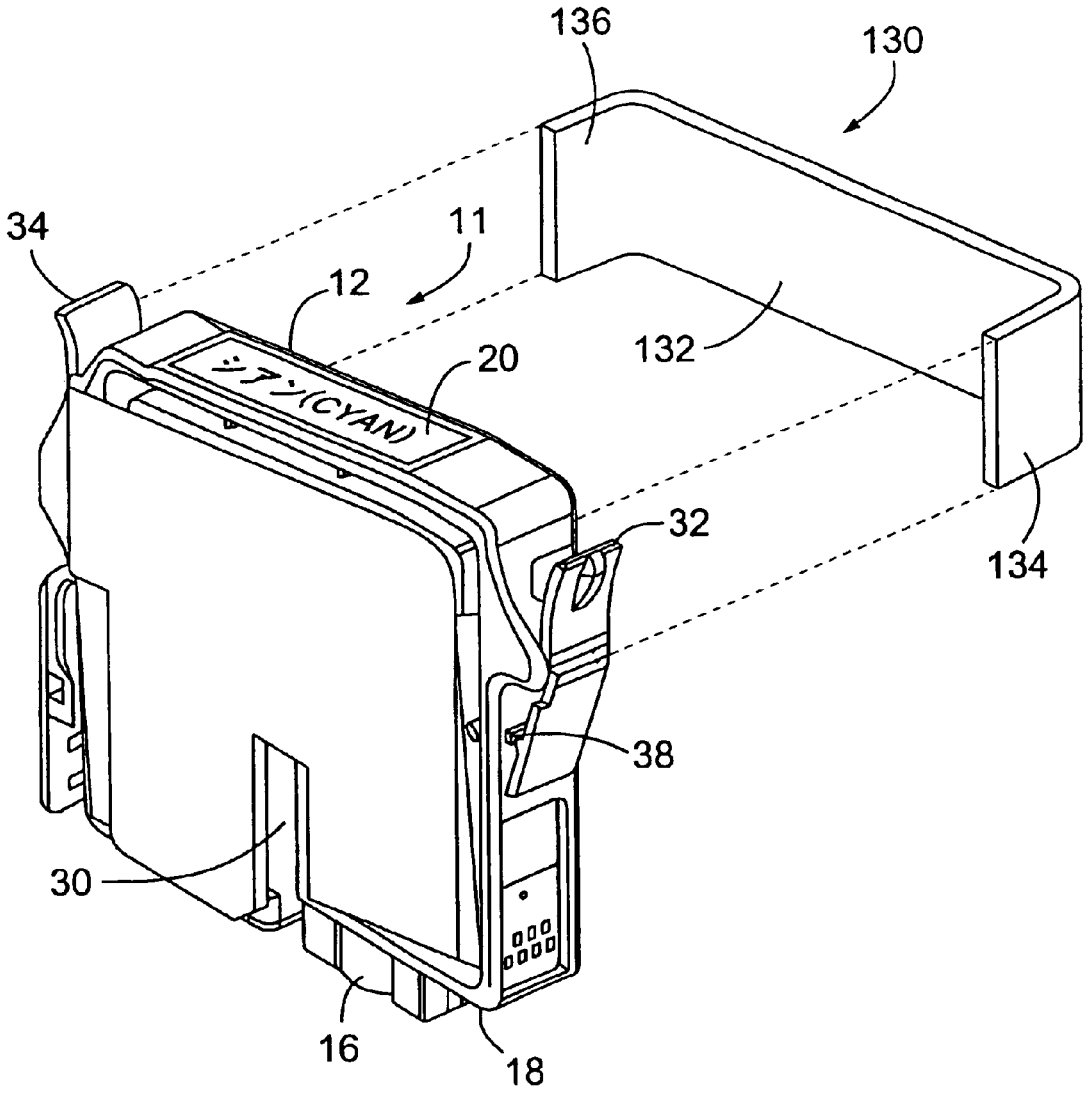
FIG. 8 is an oblique view of an ink cartridge and a deformation prevention member of an ink cartridge vacuum package according to a non-limiting embodiment of the invention.

FIG. 8 is an oblique view of the deformation prevention member and ink cartridge of an ink cartridge vacuum package according to another embodiment of the invention. It will be noted that features of this embodiment that are similar to previous embodiments are identified by like reference numerals and further description thereof is omitted below.

The ink cartridge 11 of this embodiment differs from the ink cartridge 10 of a previous embodiment in that it additionally has a label part 20 for displaying information relating to the ink cartridge 11. The information relating to the ink cartridge 11 might include the color of ink and the ink cartridge model number, for example. Clearly, other information may be included on the label part 20. By way of example only, the label part 20 of this embodiment is a label applied to the top of the ink cartridge body 12 indicating that the color of ink is cyan.

Similar to the deformation prevention member 80 of the previous embodiment, the deformation prevention member 130 of this embodiment has a flat main part 132, a curved first deformation prevention part 134 at one end of the main part 132 and a second deformation prevention part 136 at the other end.

When force is not applied in the direction of the ink cartridge body 12 in this embodiment, the gap between the first engaging member 32 and the side of the ink cartridge body 12 and the gap between the second engaging member 34 and the side of the ink cartridge body 12 are substantially equal. The thickness of the deformation prevention member 130 is at least substantially equal to the width of this gap. It is therefore not necessary to provide a return part on the end of the deformation prevention member as described in the previous embodiment.

As also shown in FIG. 8, the deformation prevention member 130 is positioned to avoid covering the label part 20. More specifically, the first and second deformation prevention parts 134 and 136 are inserted into the gaps respectively between first and second engaging members 32 and 34, and the ink cartridge body 12, so that the main part 132 of the deformation prevention member 130 contacts the side of the ink cartridge body 12. It should be noted that FIG. 8 shows the top of the ink cartridge 11 up, but this is for descriptive convenience only and the ink cartridge 11 can obviously be inverted as in the previous embodiment.

This embodiment provides the same benefits described above as in a previous embodiment. In addition, if a transparent packaging material is used, information relating to the ink cartridge 11 inside the ink cartridge vacuum package can be seen from outside the package because the label part 20 is not covered.

The previous embodiments describe vacuum sealing the packaging 60 after the ink cartridge 10 or 11 is placed inside the packaging 60, but the invention shall not be so limited. In a non-limiting alternative, the ink cartridge 10 or 11 can be inserted into the packaging inside a vacuum chamber.

Figure 9:
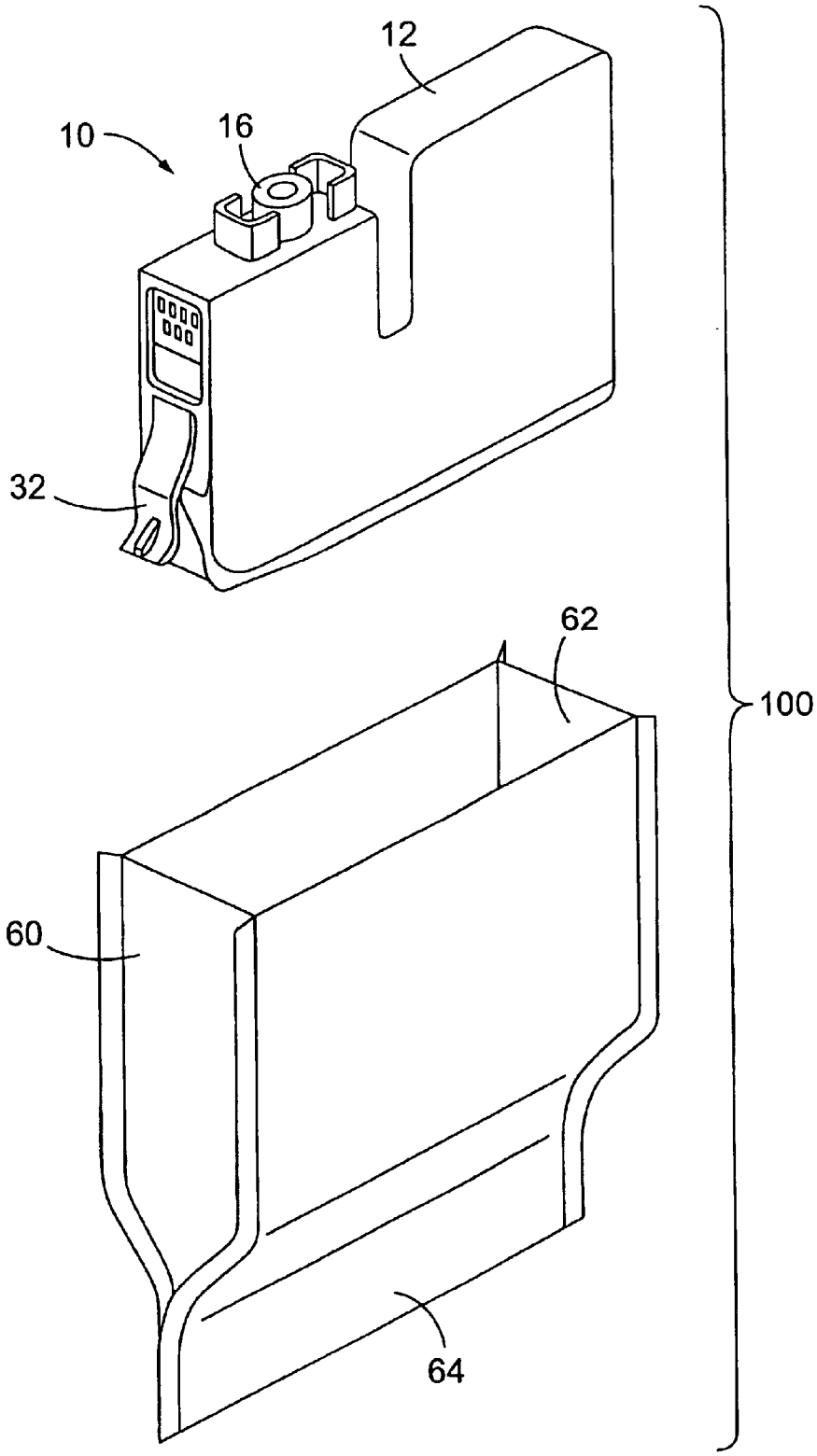
FIG. 9 is an oblique view showing an ink cartridge vacuum package according to a non-limiting embodiment of the invention.

FIG. 9 is an oblique view showing the start of a vacuum packaging method for an ink cartridge vacuum package according to another non-limiting embodiment of the invention. The ink cartridge vacuum package 100 of this embodiment has an ink cartridge 10 and packaging 60, both of which are similar to the ink cartridge 10 and packaging 60 shown in FIG. 1.

The packaging 60 is placed inside a vacuum chamber. The ink cartridge 10 is inserted into the packaging 60 through the opening 62.

The positions of the first and second engaging members 32 and 34 of the ink cartridge body 12 are then maintained without applying force to the first and second engaging members 32 and 34 of the ink cartridge 10 after the ink cartridge 10 is inserted into the packaging 60.

Figure 10:
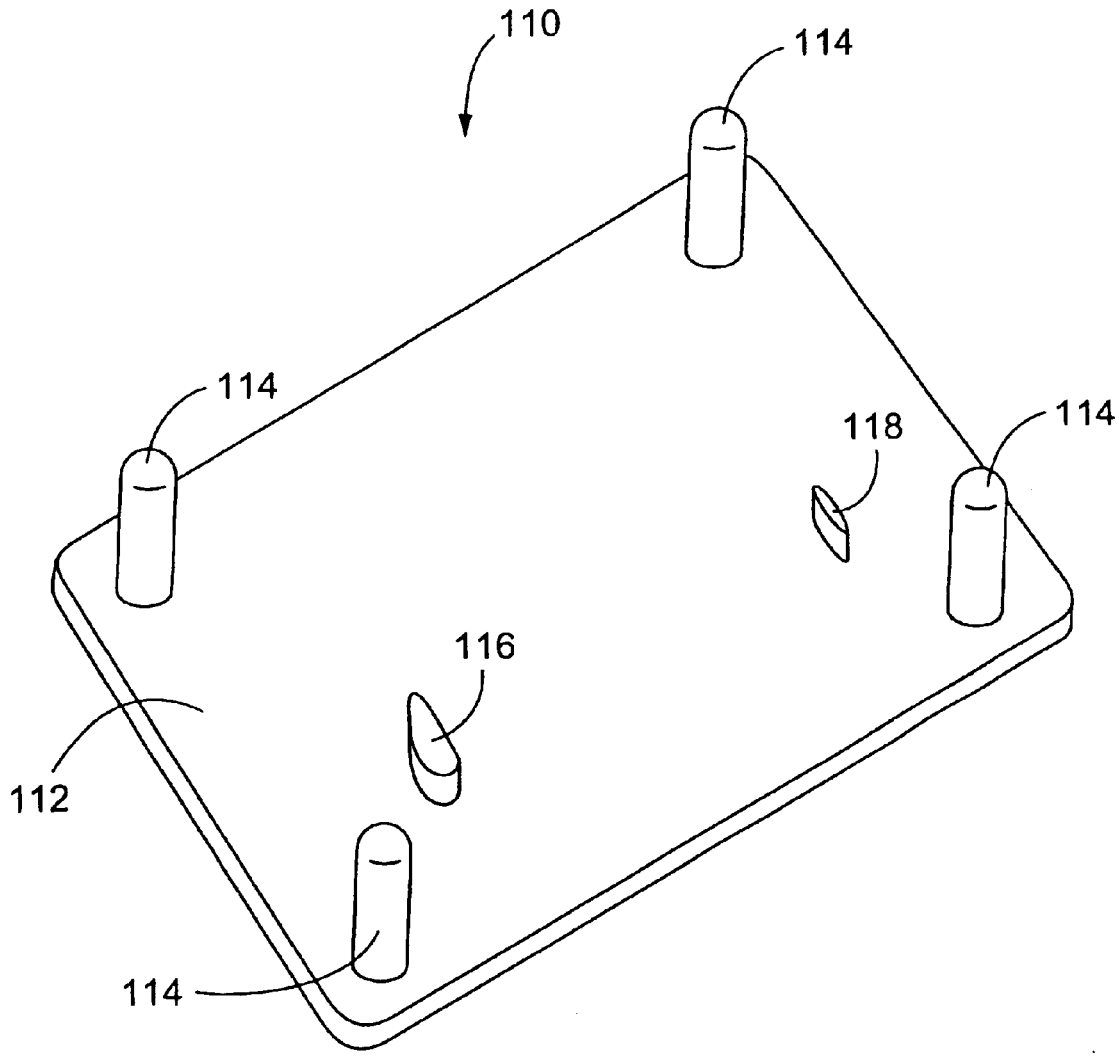
FIG. 10 is an oblique view of an illustrative example of a tray for maintaining the positions of the engaging members of the ink cartridge shown in FIG. 9.

FIG. 10 is an oblique view of an illustrative example of a tray 110 for holding the positions of the first and second engaging members 32 and 34 of the ink cartridge 10. The tray 110 has a substantially rectangular, flat main tray 112, and positioning pins 114 are disposed near the four corners of the main tray 112. The tray 110 also has a first protrusion 116 for maintaining the positional relationship of the ink cartridge body 12 and first engaging member 32. This first protrusion 116 projects from the main tray 112 and is shaped to conform to the gap between the ink cartridge body 12 and first engaging member 32 when force is not applied to the first engaging member 32.

The tray 110 also has a second protrusion 118 for maintaining the positional relationship of the ink cartridge body 12 and second engaging member 34. This second protrusion 118 likewise projects from the main tray 112 and is shaped to conform to the gap between the ink cartridge body 12 and second engaging member 34 when force is not applied to the second engaging member 34 of the ink cartridge 10.

Figure 11:
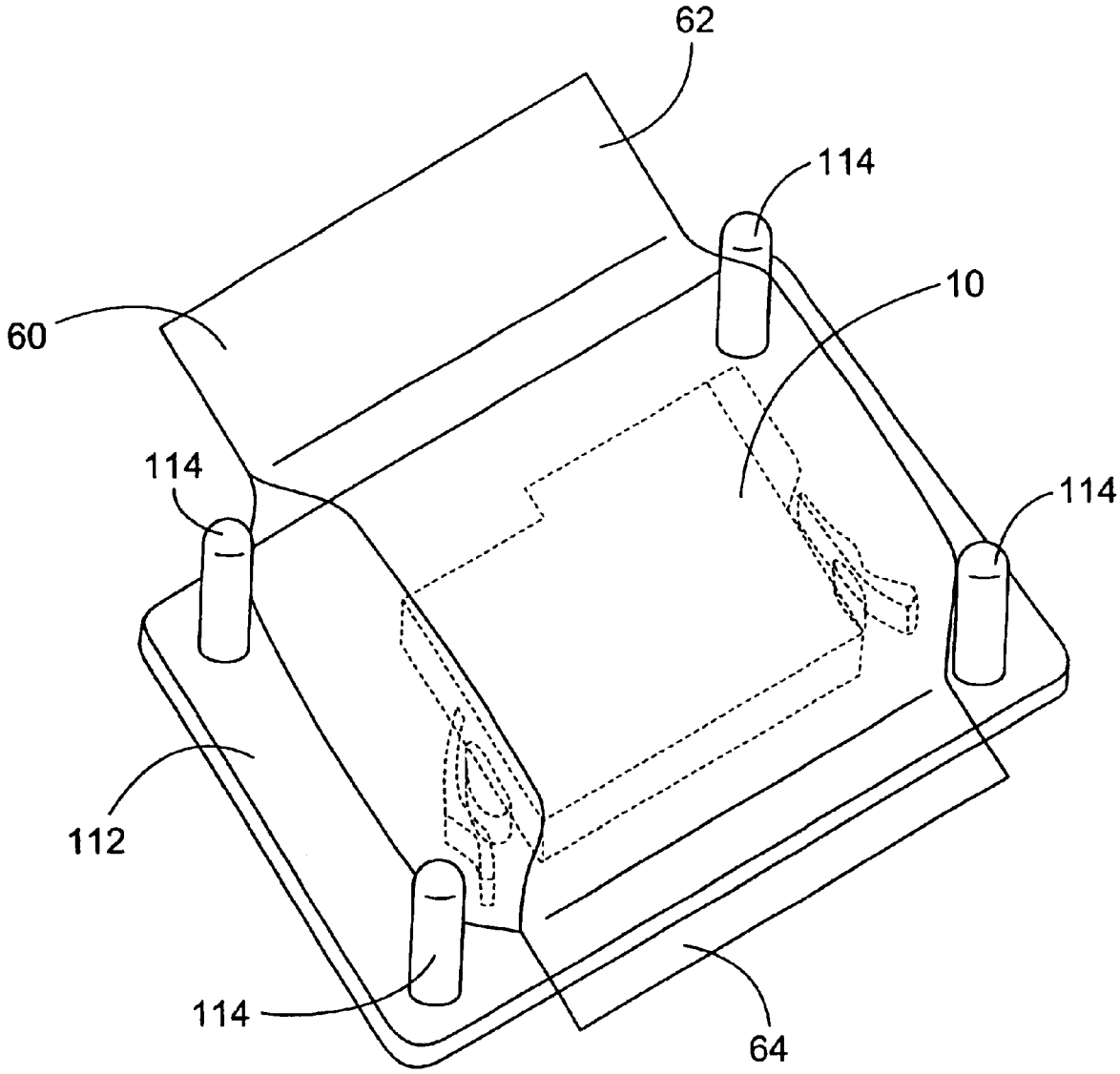
FIG. 11 is an oblique view of an example in which the tray of FIG. 9 is used to maintain positions of the engaging members.

FIG. 11 is an oblique view showing an example in which the positions of the first and second engaging members 32 and 34 of the ink cartridge 10 are maintained. In this embodiment, the positions of the engaging members 32 and 34 are maintained by the tray 110 which is in contact with the packaging 60.

After inserting the ink cartridge 10 to the packaging 60, the packaging 60 is positioned over the tray 110 so that the first and second protrusions 116 and 118 of the tray 110 are positioned in the gaps between the ink cartridge body 12 and first and second engaging members 32 and 34 of the ink cartridge 10 inside the packaging 60. The opening 62 of the packaging 60 is then sealed.

After sealing the opening 62, the packaging 60 is removed from the vacuum chamber while still on the tray 110. Because the opening 62 is sealed after removing air from inside the packaging 60, a pressure differential between the inside and outside of the packaging 60 occurs when the packaging 60 is removed from the vacuum chamber. The packaging 60 thus shrinks and the ink cartridge 10 is vacuum sealed inside the packaging 60.

Even if a force pushes the first or second engaging member 32 and 34 to the side of the ink cartridge body 12 when the packaging 60 shrinks, the first and second protrusions 116 and 118 of the tray 110 prevent the first or second engaging members 32 and 34 from moving and maintain them in the same positions as when no force is applied to the engaging members 32 and 34.

Figure 12:
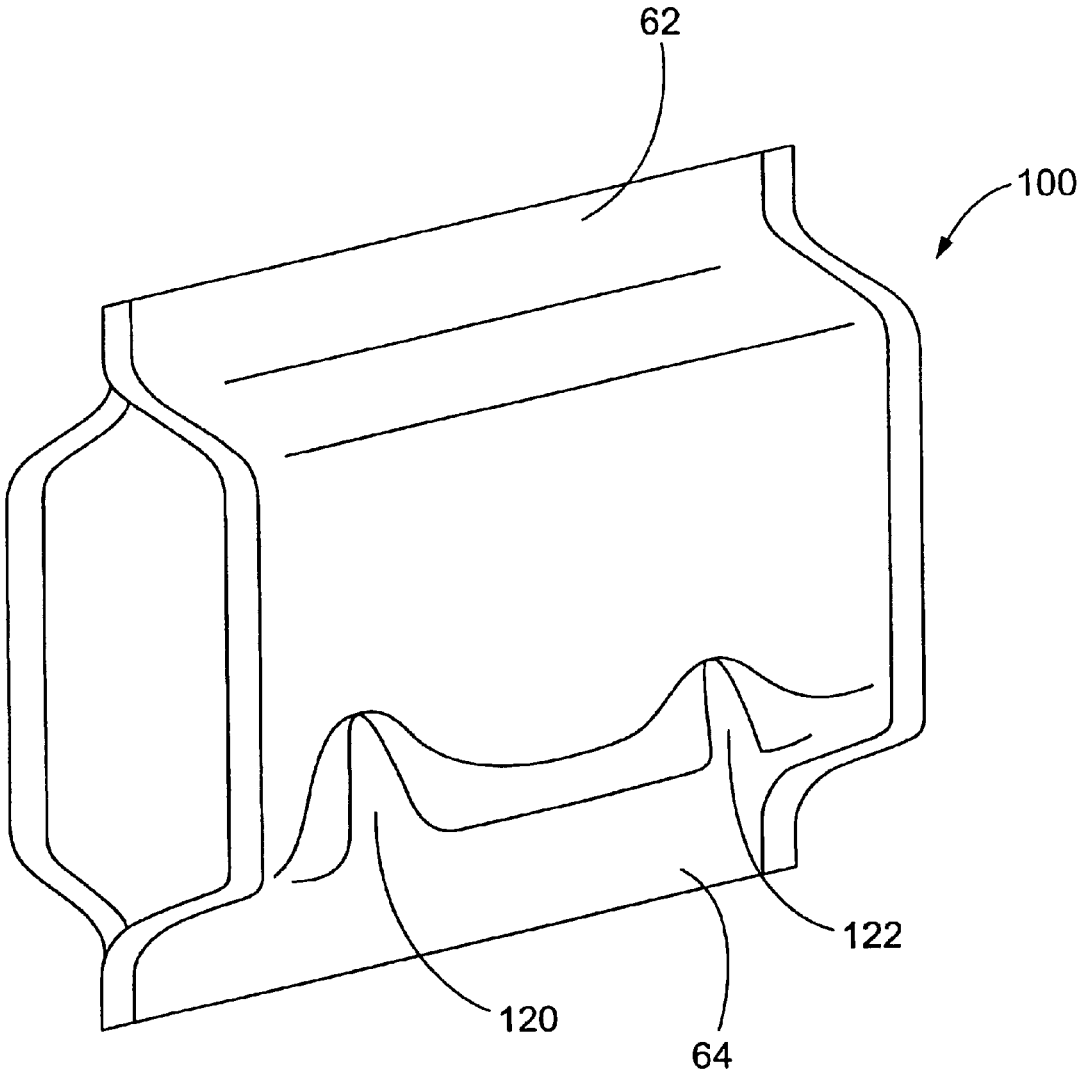
FIG. 12 is an oblique view of the ink cartridge vacuum package after the packaging of FIG. 9 shrinks.

FIG. 12 is an oblique view showing an example of the packaging 60 after it shrinks. The packaging 60 is removed from the tray 110 after it shrinks. Shrinkage of the packaging 60 causes parts 120 and 122 of the packaging 60 to remain interposed in the gaps between the first and second engaging members 32 and 34 and the ink cartridge body 12 even after the packaging 60 is removed from the tray 110, and the first and second engaging members 32 and 34 are thus held in the same positions as when no force is applied thereto. This completes the ink cartridge vacuum package 100.

The present embodiment of the invention provides the same benefits as described in some of the embodiments. In addition, the number of parts in the ink cartridge vacuum package 100 can be reduced because the positions of the engaging members 32 and 34 are maintained by using a tray 110 in contact with the outer surface of the packaging 60.

Furthermore, because the ink cartridge 10 is inserted and the opening 62 of the packaging 60 is sealed inside the vacuum chamber in this embodiment, a vacuum is more reliably created inside the packaging 60.

The previous description, including the ink cartridge 10 or 11, ink cartridge body 12, first and second engaging members 32 and 34, deformation prevention member 80 or 90, first deformation prevention part 84 or 94, second deformation prevention part 86 or 96, and other components, are not limited to the shapes, structures, and orientations shown in the figures. Various modifications to the shapes, structures, and orientations of each component will be readily apparent to those skilled in the art.

The previous description of the preferred embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. For example, some or all of the features of the different embodiments discussed above may be combined into a single embodiment. Conversely, some of the features of a single embodiment discussed above may be deleted from the embodiment. Therefore, the present invention is not intended to be limited to the embodiments described herein but is to be accorded the widest scope as defined by the limitations of the claims and equivalents.

What is claimed is:

1. A package comprising:

an ink cartridge having an ink cartridge body and a flexible engaging member disposed on and projecting away from the ink cartridge body;

a rigid deformation prevention member interposed between the flexible engaging member and the ink cartridge body; and a packaging that stores the ink cartridge, wherein, when the ink cartridge is stored in the packaging, a force in the direction of the ink cartridge body does not substantially flex the flexible engaging member.

2. A package according to claim 1, wherein the flexible engaging member comprises a first engaging member and a second engaging member disposed on two opposite sides of the ink cartridge body, and wherein the rigid deformation prevention member comprises a first deformation prevention part that is inserted between the ink cartridge body and the first engaging member, and a second deformation prevention part that is inserted between the ink cartridge body and the second engaging member.

3. A package according to claim 2, wherein the overall thickness of the first deformation prevention part is approximately the same as the gap between the first engaging member and the ink cartridge body and the overall thickness of the second deformation prevention part is approximately the same as the gap between the second engaging member and the ink cartridge body.

4. A package according to claim 1, wherein the ink cartridge further has an ink supply opening for supplying ink, and wherein the deformation prevention member has a supply opening protection part that covers the ink supply opening of the ink cartridge.

5. A package according to claim 1, wherein the ink cartridge further has a label part that contains information relating to the ink cartridge, and wherein the deformation prevention member is positioned relative to the ink cartridge so that the deformation prevention member does not cover the label part.

6. A package according to claim 1, wherein the deformation prevention member has a flat main part, a first deformation prevention part at one end of the main part and a second deformation prevention part at the other end of the main part.

7. A package according to claim 6, wherein the end of the first deformation prevention part is bent backwards.

8. A package according to claim 7, wherein the flexible engaging member comprises a first engaging member and a second engaging member disposed on two opposite sides of the ink cartridge body, and wherein the first deformation prevention part is inserted between the ink cartridge body and the first engaging member, and the second deformation prevention part is inserted between the ink cartridge body and the second engaging member.

9. A package according to claim 1, wherein the deformation prevention member is detachably coupled to the ink cartridge.

10. A package according to claim 1, wherein the deformation prevention member is housed inside the packaging.

11. A packaging method comprising:

inserting an ink cartridge into a packaging through an opening;

maintaining a flexible engaging member in a substantially same position, relative to an ink cartridge body of the ink cartridge, regardless of whether force is applied to the flexible engaging member in a direction of the ink cartridge body, wherein the flexible engaging member is disposed on and projects from the ink cartridge body;

forming a vacuum inside the packaging in which the ink cartridge is inserted; and sealing the opening of the packaging in which the ink cartridge is inserted, wherein the operation of maintaining the flexible engaging member in the substantially same position comprises inserting a rigid deformation prevention member between the ink cartridge body and the flexible engaging member.

12. A packaging method according to claim 11, wherein the ink cartridge is inserted into the packaging in a vacuum chamber.

13. A packaging method according to claim 11, wherein the operation of forming the vacuum comprises removing air from the opening of the packaging while the ink cartridge is in side the packaging.

14. A packaging method comprising:

inserting an ink cartridge into a packaging through an opening;

maintaining a flexible engaging member in a substantially same position, relative to an ink cartridge body of the ink cartridge, regardless of whether force is applied to the flexible engaging member in a direction of the ink cartridge body, wherein the flexible engaging member is disposed on and projects from the ink cartridge body;

forming a vacuum inside the packaging in which the ink cartridge is inserted; and sealing the opening of the packaging in which the ink cartridge is inserted, wherein the operation of maintaining the engaging member in the substantially same position comprises maintaining the position of the engaging member through contact of a tray with an outer surface of the packaging.

15. A packaging method according to claim 14, wherein the ink cartridge is inserted into the packaging in a vacuum chamber.

16. A packaging method according to claim 14, wherein the operation of forming the vacuum comprises removing air from the opening of the packaging while the ink cartridge is inside the packaging.

17. A packaging method according to claim 14, wherein after sealing the opening, a part of the packaging maintains the engaging member in the same position as when no force is applied to the engaging member.

18. A packaging method, comprising:

inserting an ink cartridge into a packaging through an opening;

maintaining a flexible engaging member in a substantially same position, relative to an ink cartridge body of the ink cartridge, regardless of whether force is applied to the flexible engaging member in a direction of the ink cartridge body, wherein the flexible engaging member is disposed on and projects from the ink cartridge body;

forming a vacuum inside the packaging in which the ink cartridge is inserted; and sealing the opening of the packaging in which the ink cartridge is inserted, wherein after sealing the opening, a part of the packaging maintains the engaging member in the substantially same position.

19. A packaging method according to claim 18, wherein the ink cartridge is inserted into the packaging in a vacuum chamber.

20. A packaging method according to claim 18, wherein the operation of forming the vacuum comprises removing air from the opening of the packaging while the ink cartridge is inside the packaging.

21. An ink cartridge package unit, comprising:

an ink cartridge having an ink cartridge body and a flexible engaging member disposed on and projecting away from the ink cartridge body;

a packaging storing the ink cartridge; and a rigid deformation prevention member disposed to prevent a force in the direction of the ink cartridge body from substantially flexing the flexible engaging member;

wherein the deformation prevention member comprises one or more deformation prevention parts, and a supply opening protection part.

22. The package of claim 21, wherein the deformation prevention parts are spaced apart from each other by a main part, and the supply opening protection part is spaced apart from the main part by a connecting part.

23. The package of claim 21, wherein the ink cartridge has an ink supply opening and the supply opening protection part covers the ink supply opening.

24. The package of claim 21, wherein:

the flexible engaging member comprises a first engaging member and a second engaging member disposed on two opposite sides of the ink cartridge body;

a first one of the deformation prevention parts is disposed between the ink cartridge body and the first engaging member; and a second one of the deformation prevention parts is disposed between the ink cartridge body and the second engaging member.

25. An ink cartridge package unit, comprising:

an ink cartridge, having:

an ink cartridge body with a label part and at least one ink cartridge side located adjacent the label part, and a flexible engaging member disposed on and projecting away from the ink cartridge body; and a packaging storing the ink cartridge, comprising a rigid deformation prevention member disposed so as to prevent a force in the direction of the ink cartridge body from substantially flexing the flexible engaging member;

wherein, when the ink cartridge is in the packaging, the label part is free from being covered by the deformation prevention member.

26. The package of claim 25, wherein:

the flexible engaging member comprises a first engaging member and a second engaging member spaced apart by a main part and disposed on two opposite sides of the ink cartridge body;

the first deformation prevention part is inserted between the ink cartridge body and the first engaging member;

the second deformation prevention part is inserted between the ink cartridge body and the second engaging member; and the main part is adjacent the ink cartridge side.

27. A packaging method, comprising:

inserting an ink cartridge, having an ink cartridge body and a flexible engaging member disposed on and projecting from the ink cartridge body, into a packaging through an opening;

bringing a tray, having at least one protrusion projecting therefrom, into contact with an outer surface of the packaging such that the protrusion pushes a part of the packaging between the flexible engaging member and the ink cartridge body; and forming a vacuum inside the packaging.

28. The packaging method of claim 27, further comprising maintaining the flexible engaging member in substantially the same position, relative to the ink cartridge body, regardless of the presence of force applied, in a direction of the ink cartridge body, to the flexible engaging member.

29. The packaging method of claim 27, further comprising:

sealing the packaging after the forming of the vacuum; and withdrawing the tray from contact with the outer surface of the packaging;

wherein at least one of the vacuum and the part of the packaging between the flexible engaging member and the ink cartridge body maintains the flexible engaging member in substantially the same position, relative to the ink cartridge body, regardless of the presence of force applied, in a direction of the ink cartridge body, to the flexible engaging member.

30. The packaging method according to claim 27, wherein the inserting step is performed in a vacuum chamber.

31. The packaging method according to claim 27, wherein the forming of the vacuum comprises removing air from the opening of the packaging while the ink cartridge is inside the packaging.

32. A package, comprising:

an ink cartridge having an ink cartridge body and a flexible engaging member disposed on and projecting away from the ink cartridge body;

a packaging that stores the ink cartridge;

a vacuum within the packaging; and a portion of the packaging interposed between the ink cartridge body and the flexible engaging member, preventing a force in the direction of the ink cartridge body from substantially flexing the flexible engaging member.

* * * * *